US010392871B2

(12) United States Patent
Fenwick

(10) Patent No.: US 10,392,871 B2
(45) Date of Patent: Aug. 27, 2019

(54) EARTH BORING SYSTEMS AND METHODS WITH INTEGRAL DEBRIS REMOVAL

(71) Applicant: American Piledriving Equipment, Inc., Kent, WA (US)

(72) Inventor: Matthew E. Fenwick, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 273 days.

(21) Appl. No.: 15/352,064

(22) Filed: Nov. 15, 2016

(65) Prior Publication Data

US 2017/0138133 A1 May 18, 2017

Related U.S. Application Data

(60) Provisional application No. 62/256,996, filed on Nov. 18, 2015.

(51) Int. Cl.

| | |
|---|---|
| ***E21B 17/046*** | (2006.01) |
| ***E21B 17/02*** | (2006.01) |
| ***E21B 21/01*** | (2006.01) |
| ***E21B 10/42*** | (2006.01) |
| ***E21B 10/60*** | (2006.01) |
| ***E21B 17/18*** | (2006.01) |

(52) U.S. Cl.

CPC ..... *E21B 17/046* (2013.01); *E21B 10/42* (2013.01); *E21B 10/60* (2013.01); *E21B 17/18* (2013.01)

(58) Field of Classification Search

CPC ..... E21B 17/02; E21B 17/046; E21B 21/01

See application file for complete search history.

(56) References Cited

U.S. PATENT DOCUMENTS

| | | | |
|---|---|---|---|
| 48,515 | A | 7/1865 | Campbell et al. |
| 500,780 | A | 7/1893 | Simon |
| 628,962 | A | 7/1899 | Speer |
| 910,421 | A | 1/1909 | Schlueter |

(Continued)

FOREIGN PATENT DOCUMENTS

| | | | |
|---|---|---|---|
| CA | 2394894 | A1 | 8/2003 |
| CA | 2942801 | A1 | 10/2015 |

(Continued)

OTHER PUBLICATIONS

USPTO, "Final Office Action, U.S. Appl. No. 15/285,326,", dated Aug. 14, 2017, 10 pages.

(Continued)

*Primary Examiner* — Catherine Loikith

(74) *Attorney, Agent, or Firm* — Michael R. Schacht; Schacht Law office, Inc.

(57) ABSTRACT

A drill string comprising a bit portion, a distal extension portion, a proximal extension portion, and a connecting portion. The bit portion is operatively connected to the distal extension portion and the connecting portion operatively connects the distal extension portion to the proximal extension portion to define supply path and a return path. The supply path extends through the distal proximal extension portion, the connecting portion, the distal extension portion, and the bit portion to a cutter region associated with the bit portion. The return path extends from the cutter region through the bit portion, the distal extension portion, the connector portion, and the proximal extension portion.

21 Claims, 9 Drawing Sheets

(56) References Cited

U.S. PATENT DOCUMENTS 999,334 A 8/1911 Pearson
1,288,989 A 12/1918 Rees
1,294,154 A 2/1919 Payne
1,322,470 A 11/1919 Schenk
1,464,231 A 8/1923 Yezek
1,654,093 A 12/1927 Reid
1,684,816 A 9/1928 Arden
1,787,000 A 12/1930 Hunt
1,903,555 A 4/1933 Robertson
2,101,285 A 12/1937 Stevens
2,128,428 A 8/1938 Murray, Jr.
2,232,845 A 2/1941 Fieroh
2,239,024 A 4/1941 Vance
2,350,921 A 6/1944 Pinazza
2,436,251 A 2/1948 Dobie et al.
2,439,219 A 4/1948 O'Connor
2,577,252 A 12/1951 Kjellman
2,760,747 A 8/1956 Mordarski
2,952,132 A 9/1960 Urban
2,975,846 A 3/1961 Bodine
3,004,389 A 10/1961 Muller
3,059,436 A 10/1962 Hermann, Jr.
3,106,258 A 10/1963 Muller
3,115,198 A 12/1963 Kuss
3,172,485 A 3/1965 Spannhake et al.
3,175,630 A 3/1965 Hein et al.
3,278,235 A 10/1966 Bergstrom
3,280,924 A 10/1966 Tatamikov
3,287,983 A 11/1966 Austin et al.
3,300,987 A 1/1967 Maeda
3,313,376 A 4/1967 Holland
3,371,727 A 3/1968 Belousov et al.
3,381,422 A 5/1968 Olson
3,391,435 A 7/1968 Lebelle
3,394,766 A 7/1968 Lebelle
3,396,805 A 8/1968 Muller
3,411,305 A 11/1968 Cella
3,412,813 A 11/1968 Johnson
3,460,637 A 8/1969 Schulin
3,513,587 A 5/1970 Artur
3,528,302 A 9/1970 Kinnan
3,530,947 A 9/1970 Gendron
3,577,645 A 5/1971 Zurawski
3,583,497 A 6/1971 Kossowski et al.
3,684,037 A 8/1972 Bodine
3,686,877 A 8/1972 Bodin
3,711,161 A 1/1973 Proctor et al.
3,786,874 A 1/1974 Demichelis et al.
3,786,878 A * 1/1974 Chapman ..... E21B 17/18 175/106
3,808,820 A 5/1974 Bodine
3,828,864 A 8/1974 Haverkamp et al.
3,865,501 A 2/1975 Kniep
3,871,617 A 3/1975 Majima
3,874,244 A 4/1975 Rasmussen et al.
3,891,186 A 6/1975 Thorsell
3,907,042 A 9/1975 Halwas et al.
3,909,149 A 9/1975 Century
3,952,796 A 4/1976 Larson
3,999,392 A 12/1976 Fukushima et al.
4,033,419 A 7/1977 Pennington
4,067,369 A 1/1978 Harmon
4,082,361 A 4/1978 Lanfermann
4,100,974 A 7/1978 Pepe
4,113,034 A 9/1978 Carlson
4,143,985 A 3/1979 Axelsson et al.
4,144,939 A 3/1979 Knothe
4,155,600 A 5/1979 Lanfermann et al.
4,166,508 A 9/1979 van den Berg
4,195,698 A 4/1980 Nakagawasai
4,274,761 A 6/1981 Boguth
4,285,405 A 8/1981 Weir
4,297,056 A 10/1981 Nottingham
4,312,413 A 1/1982 Loftis
4,351,624 A 9/1982 Barber
4,375,927 A 3/1983 Kniep
4,397,199 A 8/1983 Jahn
4,428,699 A 1/1984 Juhola
4,455,105 A 6/1984 Juhola
4,519,729 A 5/1985 Clarke et al.
4,522,304 A 6/1985 Walter
4,537,527 A 8/1985 Juhola et al.
4,547,110 A 10/1985 Davidson
4,553,443 A 11/1985 Rossfelder et al.
4,601,615 A 7/1986 Cavalli
4,603,748 A 8/1986 Rossfelder et al.
4,606,427 A 8/1986 Beer
4,616,716 A 10/1986 Bouplon
4,625,811 A 12/1986 Tuenkers
4,627,768 A 12/1986 Thomas et al.
4,632,602 A 12/1986 Hovnanian
4,637,475 A 1/1987 England et al.
4,645,017 A 2/1987 Bodine
4,650,008 A 3/1987 Simson
4,735,270 A 4/1988 Fenyvesi
4,755,080 A 7/1988 Cortlever et al.
4,768,900 A 9/1988 Burland
4,813,814 A 3/1989 Shibuta et al.
4,819,740 A 4/1989 Warrington
4,863,312 A 9/1989 Cavalli
4,915,180 A 4/1990 Schisler
5,004,055 A 4/1991 Porritt et al.
5,088,565 A 2/1992 Evarts
5,106,233 A 4/1992 Breaux
5,117,925 A 6/1992 White
5,213,449 A 5/1993 Morris
5,240,348 A 8/1993 Breaux
5,244,316 A 9/1993 Wright et al.
5,253,542 A 10/1993 Houze
RE34,460 E 11/1993 Ishiguro et al.
5,263,544 A 11/1993 White
5,281,775 A 1/1994 Gremillion
5,343,002 A 8/1994 Gremillion
5,355,964 A 10/1994 White
5,388,931 A 2/1995 Carlson
5,410,879 A 5/1995 Houze
5,439,326 A 8/1995 Goughnour et al.
5,529,132 A 6/1996 Evarts
5,540,295 A 7/1996 Serrette
5,544,979 A 8/1996 White
5,549,168 A 8/1996 Sadler et al.
5,549,170 A 8/1996 Barrow
5,562,169 A 10/1996 Barrow
5,609,380 A 3/1997 White
5,653,556 A 8/1997 White
5,658,091 A 8/1997 Goughnour et al.
5,794,716 A 8/1998 White
5,800,096 A 9/1998 Barrow
5,811,741 A 9/1998 Coast et al.
5,860,482 A 1/1999 Gremillion et al.
6,039,508 A 3/2000 White
6,129,159 A 10/2000 Scott et al.
6,179,527 B1 1/2001 Goughnour
6,234,260 B1 5/2001 Coast et al.
6,250,426 B1 6/2001 Lombard
6,360,829 B1 3/2002 Naber et al.
6,386,295 B1 5/2002 Suver
6,394,704 B1 5/2002 Saeki et al.
6,427,402 B1 8/2002 White
6,431,795 B2 8/2002 White
6,447,036 B1 9/2002 White
6,543,966 B2 4/2003 White
6,557,647 B2 5/2003 White
6,582,158 B1 6/2003 Van Stein
6,648,556 B1 11/2003 White
6,672,805 B1 1/2004 White
6,732,483 B1 5/2004 White
6,736,218 B1 5/2004 White
6,896,448 B1 5/2005 White
6,908,262 B1 6/2005 White
6,942,430 B1 9/2005 Suver
6,988,564 B2 1/2006 White
7,080,958 B1 7/2006 Morris
7,168,890 B1 1/2007 Evarts

(56) References Cited

U.S. PATENT DOCUMENTS

| | | | |
|---|---|---|---|
| 7,392,855 | B1 | 7/2008 | White |
| 7,694,747 | B1 | 4/2010 | White |
| 7,708,499 | B1 | 5/2010 | Evarts |
| 7,824,132 | B1 | 11/2010 | White |
| 7,854,571 | B1 | 12/2010 | Evarts |
| 7,914,236 | B2 | 3/2011 | Neville |
| 7,950,877 | B2 | 5/2011 | Evarts |
| 8,070,391 | B2 | 12/2011 | White |
| 8,181,713 | B2 | 5/2012 | White |
| 8,186,452 | B1 | 5/2012 | White et al. |
| 8,434,969 | B2 | 5/2013 | White |
| 8,496,072 | B2 | 7/2013 | White |
| 8,763,719 | B2 | 7/2014 | White |
| 9,249,551 | B1 | 2/2016 | White |
| 9,255,375 | B2 | 2/2016 | Yingling et al. |
| 9,957,684 | B2 | 5/2018 | Suver et al. |
| 2001/0002230 | A1 | 5/2001 | White |
| 2005/0039952 | A1 | 2/2005 | Hill et al. |
| 2006/0198706 | A1 | 9/2006 | Neville |
| 2010/0266344 | A1 | 10/2010 | Plotkin et al. |
| 2010/0303552 | A1 | 12/2010 | Yingling et al. |
| 2011/0162859 | A1 | 7/2011 | White |
| 2012/0292062 | A1 | 11/2012 | White |
| 2013/0149040 | A1 | 6/2013 | Evarts |
| 2014/0056652 | A1 | 2/2014 | Suver |
| 2014/0377011 | A1 | 12/2014 | Yingling et al. |
| 2015/0016893 | A1 | 1/2015 | Suver et al. |
| 2016/0356294 | A1 | 12/2016 | Fenwick et al. |
| 2017/0101759 | A1 | 4/2017 | Suver |
| 2017/0138133 | A1 | 5/2017 | Fenwick |
| 2017/0167102 | A1 | 6/2017 | Suver et al. |

FOREIGN PATENT DOCUMENTS

| | | | |
|---|---|---|---|
| CN | 102296608 | B | 7/2015 |
| DE | 4010357 | A1 | 10/1990 |
| EP | 0172960 | A1 | 3/1986 |
| EP | 362158 | | 4/1990 |
| EP | 526743 | | 10/1993 |
| FR | 838717 | | 3/1939 |
| FR | 2560247 | | 8/1985 |
| GB | 2003769 | | 3/1979 |
| GB | 2023496 | | 1/1980 |
| GB | 2028902 | | 3/1980 |
| GB | 2043755 | | 10/1980 |
| GB | 2060742 | | 5/1981 |
| GB | 2069659 | A | 8/1981 |
| JP | 5494703 | | 7/1979 |
| JP | 355098526 | | 7/1980 |
| JP | 356034828 | | 4/1981 |
| JP | 57169130 | | 10/1982 |
| JP | 59228529 | A | 12/1984 |
| JP | 61221416 | | 10/1986 |
| JP | 0258627 | | 2/1990 |
| JP | 497015 | A | 3/1992 |
| JP | 473035 | | 6/1992 |
| JP | 6136751 | | 5/1994 |
| JP | 2005256500 | A | 9/2005 |
| JP | 2005315050 | A | 11/2005 |
| JP | 2006089933 | A | 4/2006 |
| JP | 2006177125 | A | 7/2006 |
| JP | 2006312825 | A | 11/2006 |
| JP | 2009138487 | A | 6/2009 |
| NL | 42349 | | 1/1938 |
| NL | 65252 | | 2/1950 |
| NL | 7710385 | | 3/1978 |
| NL | 7707303 | | 1/1979 |
| NL | 7805153 | | 11/1979 |
| NO | 46428 | | 4/1929 |
| RU | 2109881 | C1 | 4/1998 |
| SU | 1027357 | | 7/1983 |
| WO | WO8707673 | | 12/1987 |
| WO | WO8805843 | | 8/1988 |
| WO | 2012031108 | A1 | 3/2012 |

OTHER PUBLICATIONS

USPTO, "Non-Final Office Action, U.S. Appl. No. 15/372,196," dated Oct. 4, 2017, 23 pages.

USPTO, "Final Office Action, U.S. Appl. No. 15/285,326,", dated Apr. 25, 2018, 9 pages.

"Castle Board Drain Method", Japanese brochure, Reference Nos. APE00857 through APE00863, Aug. 1976.

"Kony Drain Board," undated, 1 page.

"The 1.sup.st Report on the Treatment of Soft Foundation of Juck Hyun Industrial Site", Ref. Nos. APE00854 through APE00856, Mar. 1976.

A report identifying systems for driving mandrels carrying wick drain material into the earth, identified by Ref. Nos. APE0510 through APE0536, (undated).

A series of photographs identified by reference Nos. APE01147 through APE01159. 1990-1993.

International Construction Equipment, Inc "Hydraulic Vibratory Driver/Extractors for Piling and Caisson Work," 10 pages.

International Construction Equipment, Inc "Hydraulic Vibratory Driver/Extractors for Piling and Caisson Work," Ref. No. V7-0890-51, 1974, 3 pages.

Korean document, Ref. Nos. APE00864 through APE00891, 1982-1997.

Schematic drawings identified by Ref. Nos. APE01038, APE01039, and APE0339, (undated).

USPTO, "Non-Final Office Action, U.S. Appl. No. 15/285,326,", dated Apr. 25, 2017, 10 pages.

* cited by examiner

EARTH BORING SYSTEMS AND METHODS WITH INTEGRAL DEBRIS REMOVAL

RELATED APPLICATIONS

This application, U.S. patent application Ser. No. 15/352,064 filed Nov. 15, 2016 claims benefit of U.S. Provisional Application Ser. No. 62/256,996 filed Nov. 18, 2015, the contents of which are incorporated herein by reference.

TECHNICAL FIELD

The present invention relates to earth boring systems and methods and, in particular, to earth boring systems and methods configured remove debris as the hole is being bored.

BACKGROUND

The present invention relates to system and methods for forming a hole in the earth and, in particular, to systems and methods that use drill fluid to remove drill cuttings as the hole is formed in the earth.

SUMMARY

The present invention may be embodied as a drill string comprising a bit portion, a distal extension portion, a proximal extension portion, and a connecting portion. The bit portion is operatively connected to the distal extension portion and the connecting portion operatively connects the distal extension portion to the proximal extension portion to define a supply path and a return path. The supply path extends through the distal proximal extension portion, the connecting portion, the distal extension portion, and the bit portion to a cutter region associated with the bit portion. The return path extends from the cutter region through the bit portion, the distal extension portion, the connector portion, and the proximal extension portion.

The present invention may also be embodied as a method of forming a hole in the earth comprising the following steps. A bit portion is operatively connected to a distal extension portion. The distal extension portion is operatively connected to a proximal extension portion to define a supply path and a return path. The supply path extends through the distal proximal extension portion, the connecting portion, the distal extension portion, and the bit portion to a cutter region associated with the bit portion. The return path extends from the cutter region through the bit portion, the distal extension portion, the connector portion, and the proximal extension portion. The bit portion is engaged with the earth. The proximal portion is rotated to cause rotation of the bit portion through the distal extension portion. Drill fluid is forced through the supply path and to the cutter region. The drill fluid in the cutter region is collected through the return path.

The present invention may also be embodied as an earth boring system for forming a hole in the earth comprising a drill string, a drive system, a drill fluid supply, and a drill debris collector. The drill string comprises a bit portion, a distal extension portion, a proximal extension portion, and a connecting portion. The bit portion is operatively connected to the distal extension portion and the connecting portion operatively connects the distal extension portion to the proximal extension portion to define a supply path and a return path. The supply path extends through the distal proximal extension portion, the connecting portion, the distal extension portion, and the bit portion to a cutter region associated with the bit portion. The return path extends from the cutter region through the bit portion, the distal extension portion, the connector portion, and the proximal extension portion. The drill fluid supply forces drill fluid through the supply path such that the drill fluid mixes with the cuttings in the cutter region to form drill debris and the drill debris flows back up through the return path. The drill debris collector collects the drill debris.

DETAILED DESCRIPTION

Figure 1:
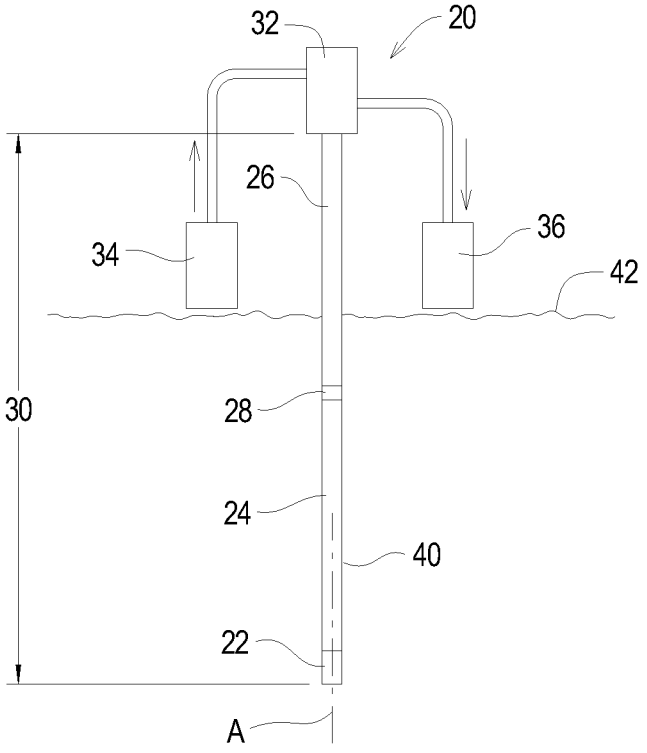
FIG. 1 is a somewhat schematic, side elevation view of a first example earth boring system of the present invention depicting a drill string comprising a bit portion, a distal extension portion, a proximal extension portion, and a connector portion.
Figure 2:
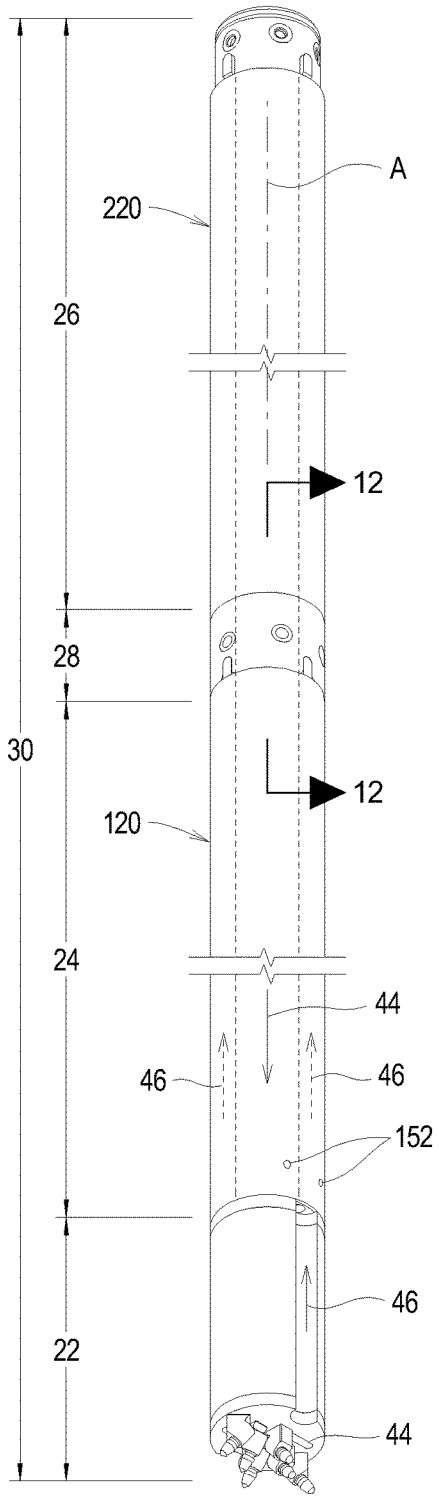
FIG. 2 is a perspective view of the drill string of the first example earth boring system of the present invention.
Figure 3:
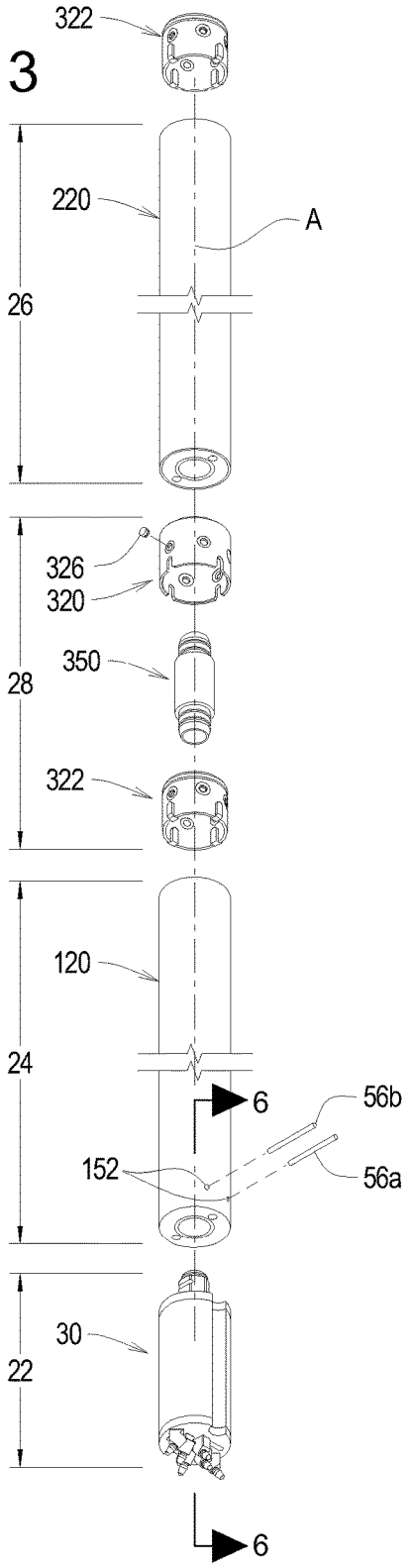
FIG. 3 is an exploded, perspective view of the drill string of the first example earth boring system.
Figure 4:
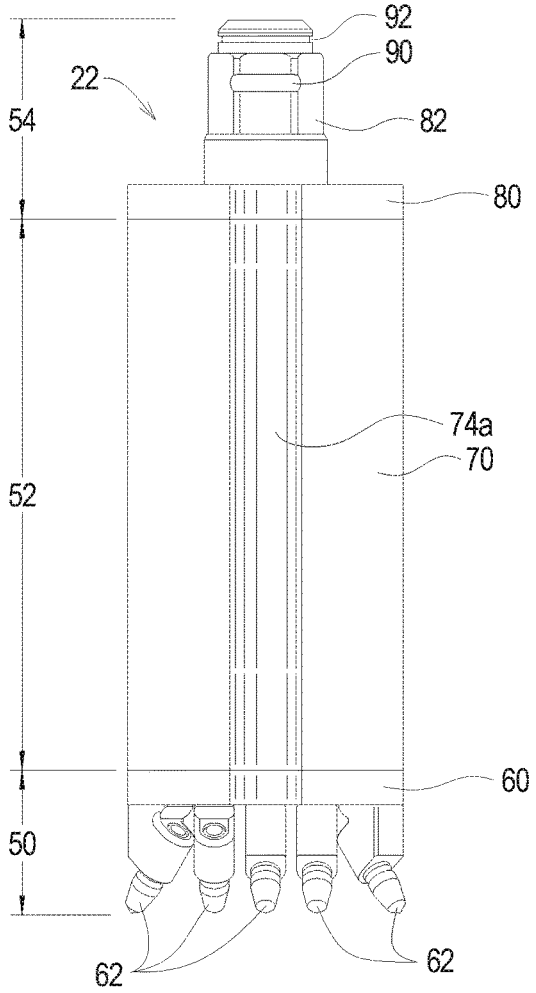
FIG. 4 is a side elevation view of a first example bit portion of the first example earth boring system.

Referring initially to FIGS. 1-3 of the drawing, depicted therein is a first example earth boring system 20 of the present invention. The first example earth boring system 20 comprises a bit portion 22, a distal extension portion 24, a proximal extension portion 26, and a connector portion 28.

The distal extension portion 24 is connected to the bit portion 22 and the connector portion 28 connects the distal extension portion 24 to the proximal extension portion 26 to form a drill string 30 defining a string axis A. FIG. 1 further illustrates that earth boring system 20 comprises, in addition to the drill string 30, a drive system 32, a drill fluid supply 34, and a drill debris collector 36. In this discussion, the terms "distal" and "proximal" are used with respect to the drive system 32.

The drive system 32 is configured to rotate the drill string 30 axially about the string axis A, to transfer drill fluid from the drill fluid supply 34 to the drill string 30, and to transfer drill debris from the drill string 30 to the drill debris collector 36. In particular, FIG. 1 further illustrates that the earth boring system 20 is adapted to form a hole 40 in the earth 42. Only two extension portions are employed in the first example earth boring system 20, but only one connector portion or more than two connector portions may be used as necessary to create a drill string that allows the earth boring system 20 to bore the hole 40 in the earth 42 to a desired depth.

During use, the drill string 30 is supported a desired angle at a desired point on the earth, and the drive system 32 is operatively connected to the drill string 30. Operation of the drill system 32 to cause axial rotation of the drill string 30 causes the bit portion 22 to bore the hole 40. At the same time, the drill fluid supply 34 forces drill fluid along a supply path 44 (FIG. 2) formed by the drill string 30 to the bit portion 22. Cuttings formed as the bit portion 22 engages the earth 42 are carried by the drill fluid back up the drill string 30 along a return path 46 (FIG. 2) and are deposited in the drill debris collector 36.

With the foregoing general understanding of the construction and operation of the first example earth boring system 20 in mind, the details of the example drill string 30 will now be described in detail. In the following example, letter appendices to reference characters are employed to indicate a specific example a part or feature but are not intended to be separate or distinguishable from the generic form of that part or feature.

Referring now to FIGS. 4-7, the first example bit portion 22 will now be described in further detail. As perhaps best shown in FIG. 6, the example bit portion 22 comprises a cutter assembly 50, a bit housing 52, a bit coupler 54, at least one coupler pin 56, and at least one seal member 58.

Figure 5:
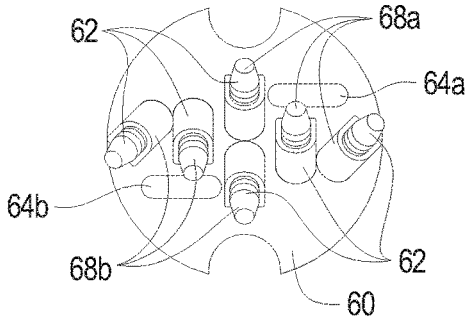
FIG. 5 is a bottom plan view of the first example bit portion.

The cutter assembly 50 comprises a cutter plate 60 and a plurality of cutter heads 62. The cutter plate 60 defines at least one cutter plate slot 64 and at least one cutter plate notch 66. FIG. 5 illustrates that the example cutter heads 62 are arranged in at least one cutter head group 68 and that one cutter plate slot 64 and one cutter plate notch 66 are associated with each cutter head group 68. In the example bit portion 22, first and second cutter head groups 68*a* and 68*b* are employed, and first and second cutter plate slots 64*a* and 64*b* and first and second cutter plate notches 66*a* and 66*b* are associated with the first and second cutter head groups 68*a* and 68*b*, respectively.

Figure 6:
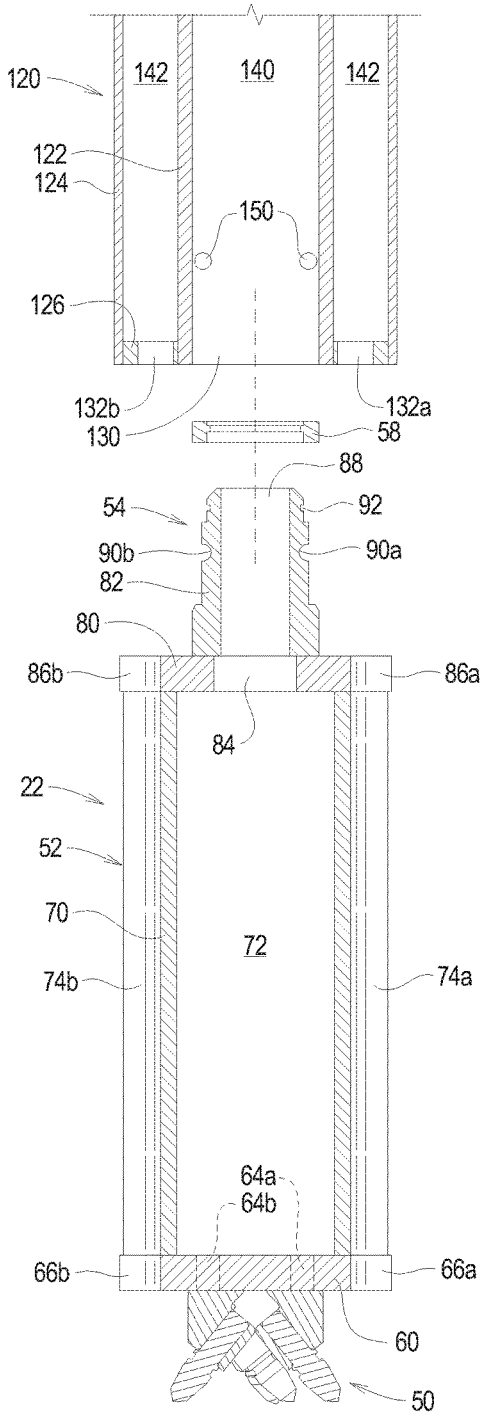
FIG. 6 is a side elevation, cutaway view taken along lines 6-6 in FIG. 3 depicting details of the process of connecting distal extension portion with the first example bit portion.
Figure 7:
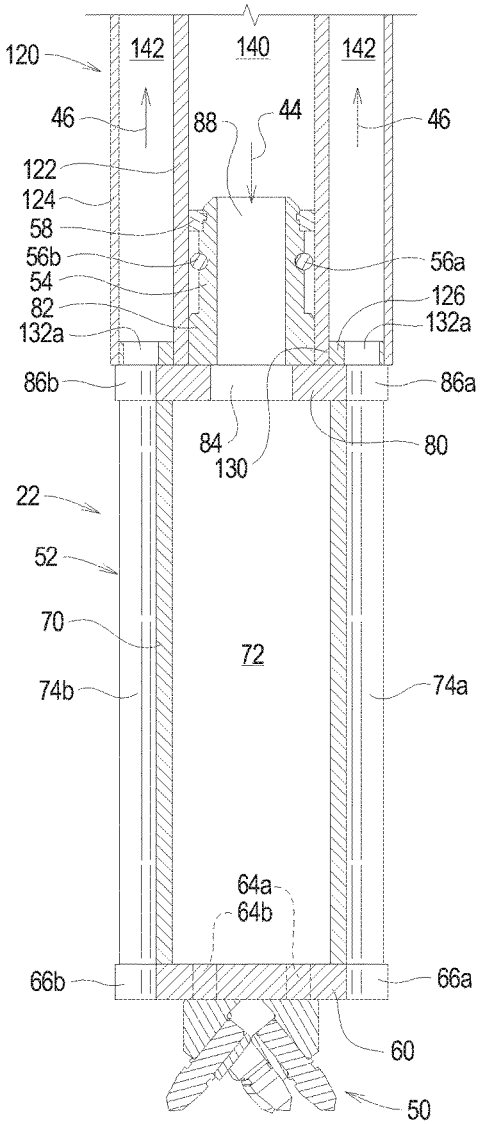
FIG. 7 is a side elevation, cutaway view taken along lines 6-6 in FIG. 3 depicting the distal extension portion connected with the first example bit portion.
Figure 8:
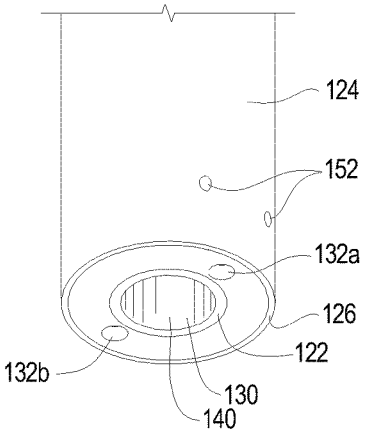
FIG. 8 is a perspective view of a distal end of the distal extension portion.
Figure 9:
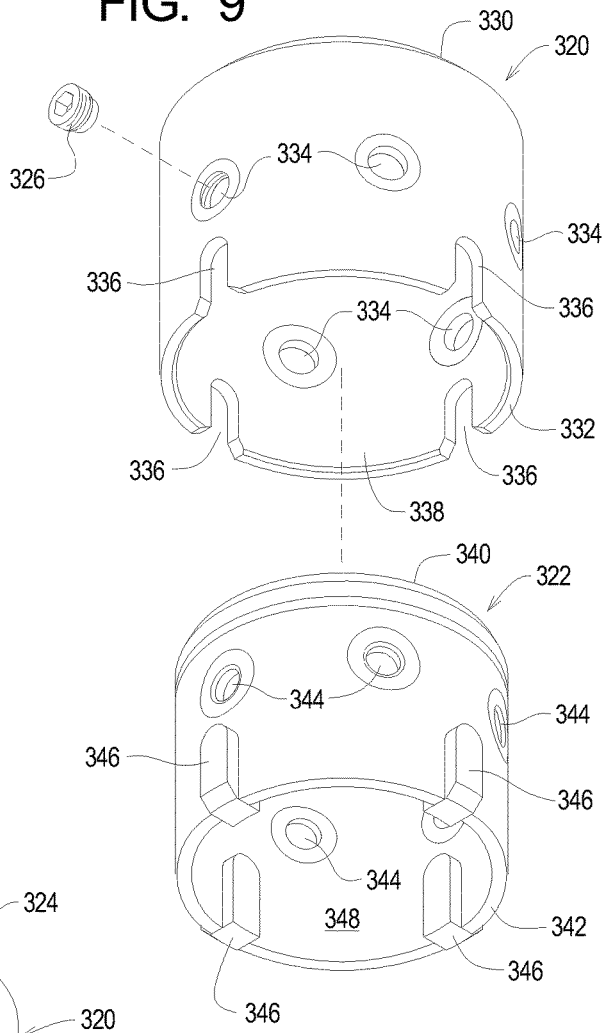
FIG. 9 is a perspective view illustrating details of the connector portion in an unconnected configuration.
Figure 10:
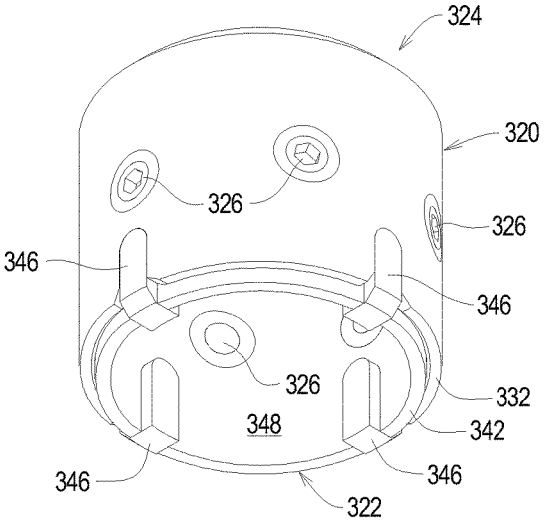
FIG. 10 is a perspective view illustrating details of the connector portion in a connected configuration.

FIGS. 6 and 7 illustrate that the example bit housing 52 comprises a bit housing member 70 defining a bit housing chamber 72 and at least one bit housing groove 74. One bit housing groove 74 is associated with each of the cutter plate notches 66, so first and second housing grooves 74*a* and 74*b* are associated with the first and second cutter plate notches 66*a* and 66*b*, respectively.

FIGS. 6 and 7 further illustrate that the example bit coupler 54 comprises a coupler plate 80 and a coupler member 82. The example coupler plate 80 defines a first coupler plate opening 84 and at least one coupler plate notch 86. The example coupler member 82 defines a coupler member passageway 88. The coupler member 82 is secured to the coupler plate 80 such that the coupler member passageway 88 is aligned with the coupler plate opening 84. In the example bit portion 22 comprising first and second housing grooves 74*a* and 74*b*, first and second coupler plate notches 86*a* and 86*b* are provided.

At least one pin groove 90 is formed in the coupler member 82. In the example drill string 30, first and second coupler pins 56*a* and 56*b* and first and second pin grooves 90*a* and 90*b* are provided. In addition, a seal groove 92 (FIG. 6) is formed on the coupler member 82 such that the coupler pin grooves 90 are arranged between the seal groove 92 and the coupler plate 80.

The example bit portion 22 is formed by securing the cutter heads 62 to the cutter head plate 60 in the first and second cutter head groups 68*a* and 68*b*. The cutter head plate 60 is secured to the bit housing member 70 to define one end of the bit housing chamber 72 with first and second coupler plate slots 64*a* and 64*b* in communication with the bit housing chamber 72 and the first and second coupler plate notches 86*a* and 86*b* in communication with the first and second bit housing grooves 74*a* and 74*b*. The coupler plate 80 is secured to the bit housing member 70 to define another end of the bit housing chamber 72 and such that the first coupler plate opening 84 is in communication with the bit housing chamber 72 and the first and second coupler plate notches 86*a* and 86*b* are aligned with the first and second bit housing grooves 74*a* and 74*b*.

Figure 11:
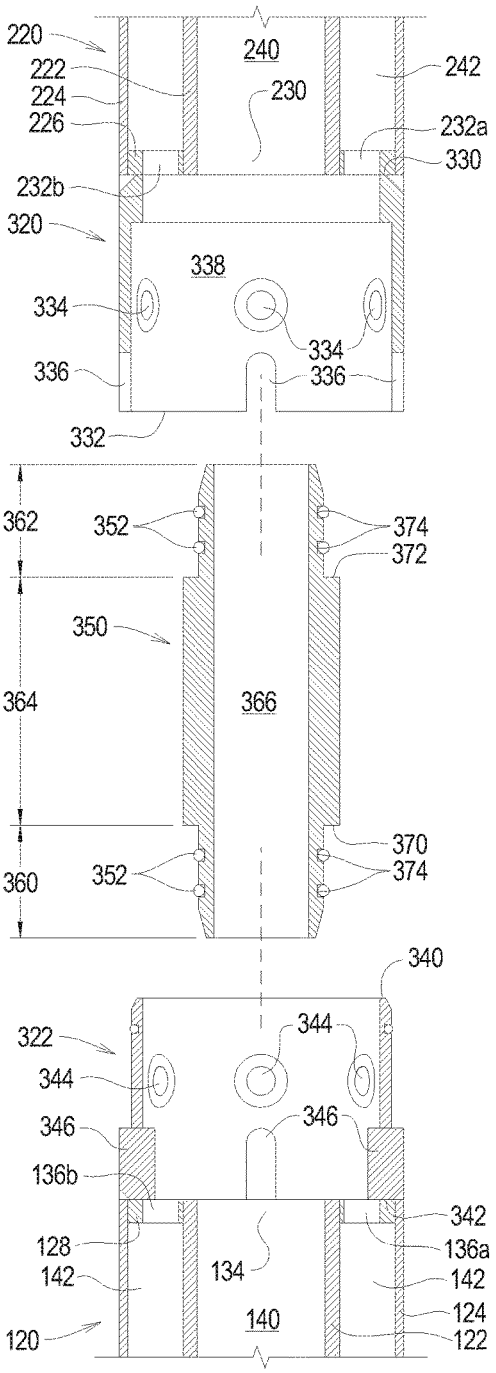
FIG. 11 is a side elevation, cutaway view depicting details of the process of connecting distal extension portion with the proximal extension portion.
Figure 12:
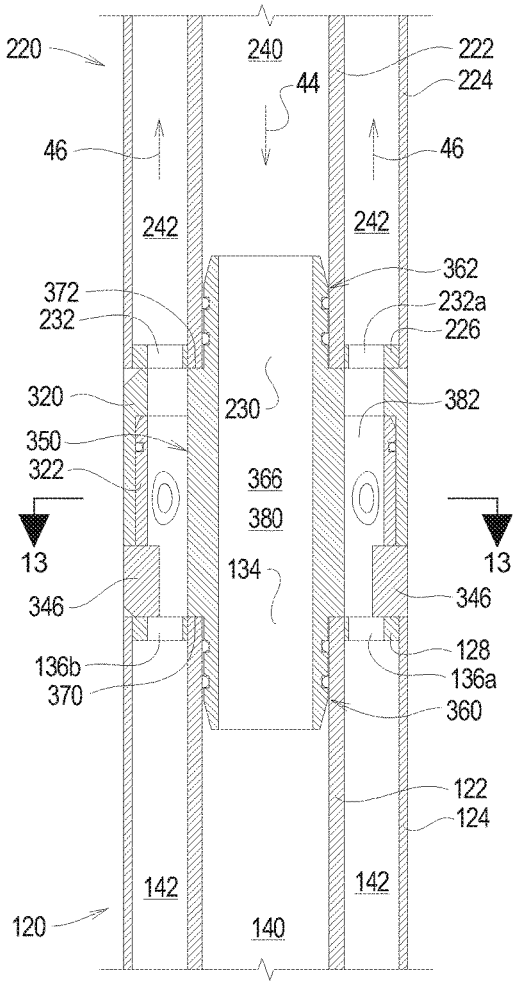
FIG. 12 is a side elevation, cutaway view taken along lines 12-12 in FIG. 2 depicting the distal extension portion connected with the proximal extension portion.

Turning now to FIGS. 6-12, the example proximal and distal extension portions 24 and 26 will now be described in detail. The example distal extension portion 24 comprises an extension housing assembly 120 comprising first and second extension housing members 122 and 124, a distal end plate 126 (FIGS. 6-8), and a proximal end plate 128 (FIGS. 11 and 12). The distal end plate 126 defines at least one supply distal end plate opening 130 and at least one removal distal end plate opening 132, while the proximal end plate 128 defines at least one supply proximal end plate opening 134 and at least one removal proximal end plate opening 136. The example end distal plate 126 define first and second removal end plate openings 132*a* and 132*b*; the example proximal end plate 128 defines first and second removal end plate openings 136*a* and 136*b*.

As shown in FIGS. 6-8, 11 and 12, the distal and proximal end plates 126 and 128 are rigidly connected to the first and second extension housing members 122 and 124 such that the supply end plate openings 130 and 134 are in fluid communication with a supply extension chamber 140 defined by the first extension housing member 122 and the removal end plate openings 132 and 136 are in fluid communication with a removal extension chamber 142 defined by the second extension housing member 124.

At least one first coupler pin opening 150 is further formed in the first extension housing member 122, and at least one second coupler pin opening 152 is formed in the second extension housing member 124. In the example drill string 30, at least one pair of the first coupler pin openings 150 and at least one pair of second coupler pin openings 152 are provided. Further, each coupler pin opening 150 and 152 may further comprise a complementary coupler pin opening (not visible in the drawing) formed in the housing members 122 and 124. The coupler pin openings 150 and 152 are sized, dimensioned, and located adjacent to the distal end plate 126 as will be described in further detail below.

FIGS. 11 and 12 illustrate that, like the distal extension portion 24, the example proximal extension portion 26 comprises an extension housing assembly 220 comprising first and second extension housing members 222 and 224, a distal end plate 226, and a proximal end plate 228 (not visible). The distal end plate 226 defines at least one supply distal end plate opening 230 and at least one removal distal end plate opening 232, while the proximal end plate 228 defines at least one supply proximal end plate opening (not visible) and at least one removal proximal end plate opening (not visible). The example end distal plate 226 defines first and second removal end plate openings 232*a* and 232*b*; the example proximal end plate 228 similarly defines first and second removal end plate openings (not visible).

As shown in FIGS. 11 and 12, the distal and proximal end plates 226 and 228 are rigidly connected to the first and second extension housing members 222 and 224 such that the supply end plate openings 230 and 234 are in fluid communication with a supply extension chamber 240 defined by the first extension housing member 222 and the removal end plate openings 232 and 236 are in fluid communication with a removal extension chamber 242 defined by the second extension housing member 224.

Desirably, but not necessarily, the distal and proximal extension portions 24 and 26 are, for the most part, the same. If additional extension portions are used to form a longer drill string than the example drill string 30, these additional extension portions will desirably, but again not necessarily, the same as the proximal end portion 26. The example proximal end portion 26 and any additional end portions need not employ pin openings such as the pin openings 150 and 152 formed in the distal end portion 24 for reasons that will become apparent below. If pin openings are formed in the proximal end portion 24 and any additional extension portions, such pin openings will not be used and may be plugged. The standardization of distal, proximal, and any additional extension portions can simplify the logistics of designing and fabricating a drill string as desired for a particular set of operating conditions at the desired location of the hole 40 to be bored into the earth 42.

FIGS. 9-13 illustrate that the example connector portion 28 comprises a first connector housing 320 and a second connector housing 322. The first and second connector housings 320 and 322 are connected to form a connector assembly 324 by connector screws 326.

The first connector housing 320 defines a first plate edge 330, a key edge 332, first screw openings 334, key slots 336, and a first connector housing passageway 338. The second connector housing 322 defines a leading edge 340, a second plate edge 342, second screw openings 344, key projections 338, and a second connector housing passageway 348.

The example connector portion 28 further comprises a connector member 350 and a plurality of seal members 352. The example connector member 350 defines first and second connector end portions 360 and 362 and an intermediate portion 364 and defines a connector passageway 366. The intermediate portion 364 defines first and second shoulder portions 370 and 372, and at least one seal groove 374 is formed on each of the first and second connector end portions 360 and 362.

The first plate edge 330 is secured to the distal end plate 226 of the proximal extension housing assembly 220, and the second plate edge 342 is secured to the proximal end plate 128 of the distal end plate housing assembly 120.

The example drill string 30 is fabricated as follows. Initially, the bit portion 22 is secured to the distal extension portion 24 as follows. The seal member 58 is arranged in the seal groove 92 on the coupler member 82, and the coupler member 82 is inserted into the supply extension chamber 140 such that the seal 58 engages an inner wall of the first extension housing member 122. The coupler pins 56*a* and 56*b* are inserted through the coupler pin openings 150*a* and 152*b* such that the coupler pins 56*a* and 56*b* are at least partly arranged within the coupler pin grooves 90*a* and 90*b*. So arranged, the coupler pins 56 prevent relative movement of the bit portion 22 and the distal end portion 24 along the string axis A. The coupler pins 56 also translate axial rotation of the extension housing assembly 120 to the bit housing 52 such that axial rotation of the drill string 30 rotates the cutter heads 62 such that the cutter heads 62 engage the earth 42 to form the hole 40 in a conventional manner.

Figure 13:
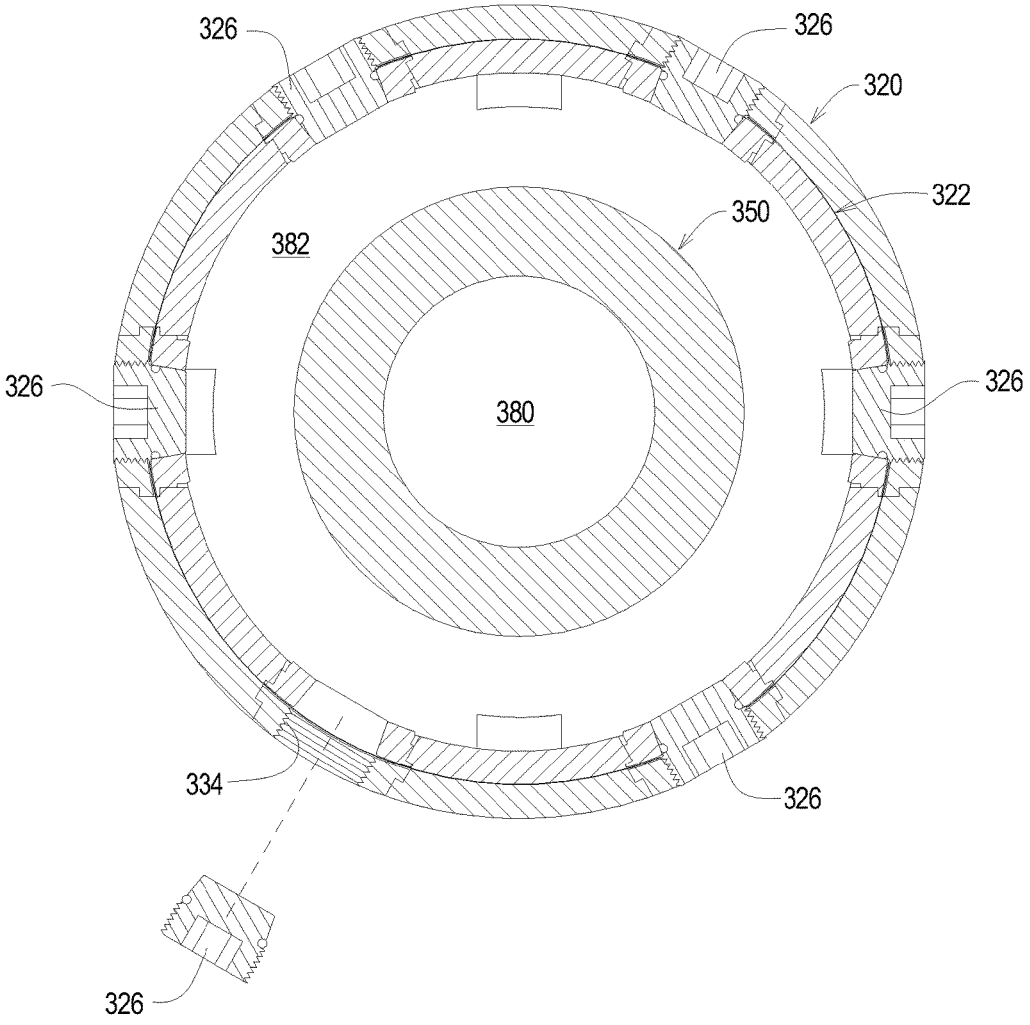
FIG. 13 is a section view taken along lines 13-13 in FIG. 12 depicting details of the process of connecting distal extension portion with the proximal extension portion.

The example connector portion 28 is then used to connect the distal and extension portion 24 to the proximal end portion 26 as follows. The seal members 352 are arranged in the seal grooves 374. The connector member 350 is arranged such that the first shoulder portion 370 engages the first extension housing member 122 of the distal extension housing assembly 120 with the seal members 352 against an inner surface of the first extension housing member 122. The leading edge 340 of the second connector housing 322 is inserted into the first connector housing passageway 338 such that: the second shoulder portion 372 of the connector portion 28 engages the first extension housing member 222 of the proximal extension housing assembly 220 with the seal members 352 against an inner surface of the first extension housing member 222; the key slots 336 receive the key projections 346; and the first and second screw openings 334 and 344 are aligned. The connector screws 326 are then inserted through the aligned screw openings 334 and 344. At least one of the screw openings 334 and 344 may be threaded to engage threads on the connector screws 326 to secure the connector screws 326 in place as shown in FIG. 13. At this point, a supply connector chamber 380 is formed within the connector bore 366, and a removal connector chamber 382 is formed within the first connector housing bore 338 and outside of the connector member 350.

The key projections 346 engage the key slots 336 to transfer axial rotation of the proximal extension housing assembly 220 to the distal extension housing assembly 120. The connector screws 326 prevent relative movement of the distal and proximal extension housing assemblies 120 and 220 relative to each other during normal operation of the drill string 30. The connector screws 326 will also transfer axial rotation of the proximal extension housing assembly 220 to the distal extension housing assembly 120.

In addition, the arrangement described above and depicted, for example, in FIGS. 7 and 12 creates the supply path 44 and return path 46 described above. In particular, the supply path 44 extends through the supply extension chamber 240 of the proximal extension housing assembly 220, through the connector member bore 366, through the supply extension chamber 140 of the distal extension housing assembly 120, through the supply connector chamber 380, through the bit housing chamber 72, out of the cutter plate slots 64, and into an active cutting region surrounding the cutter assembly 50. The return path 46 extends from the active cutting region surrounding the cutter assembly 50 up along the bit housing grooves 74 (contained by the inner wall of the hole 40), through the second coupler plate opening(s) 86, through the removal extension chamber 142 defined by the distal extension housing assembly 120, through the removal connector chamber 382 defined by the connector portion 28, and through the removal extension chamber 242 formed by the proximal extension housing assembly 220.

In use, the drill fluid supply 34 forces the drill fluid through the drive system 32 and along the supply path 44 such that the drill fluid mixes with cuttings or tailings generated by the cutter assembly 50 in the active cutting region surrounding the cutter assembly 50. Pressure on the drill fluid forces the mixture of drill fluid and cuttings or tailings out of the active cutting region and back up along the return path 46 and out of the drive system 32, where the mixture of drill fluid and cuttings or tailings is collected in the drill debris collector 36.

Although the various components of a drill string forming a part of an earth boring system of the present invention may be fabricated in many shapes, the use of parts that are generally symmetrical about a plane extending through the string axis A is desirable for a number of reasons. The bit housing 52, coupler member 82, extension housing members 122, 124, 222, and 224, first and second connector housings 320 and 322, and connector member 350 are all substantially cylindrical or have at least a portion that is cylindrical. The example supply path 44 is thus generally cylindrical. The example return path 46 is generally annular and surrounds the supply path 44.

Figure 14:
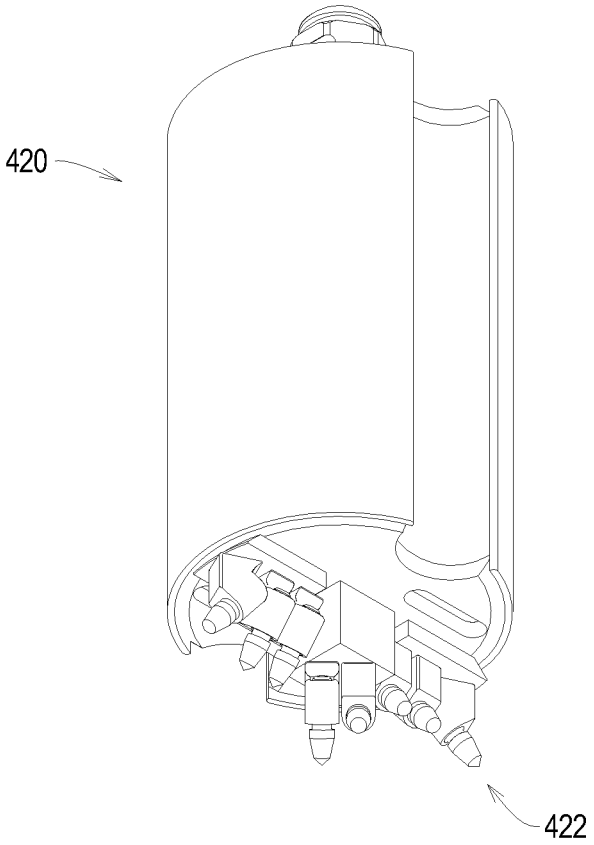
FIG. 14 is a perspective view of a second example bit portion that may be used to form a second example earth boring system of the present invention.
Figure 15:
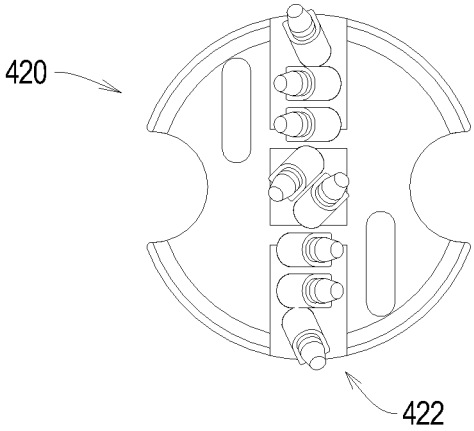
FIG. 15 is a bottom plan view of the second example bit portion.

Depicted in FIGS. 14 and 15 is a second example bit portion 420 with different dimensions and a different cutter assembly 422 than the example bit portion 22 and cutter assembly 50 described above. The second example bit portion 420 may be used as part of a drill string like the example drill string 30 with appropriate sizing of the other parts of the drill string.

Figure 16:
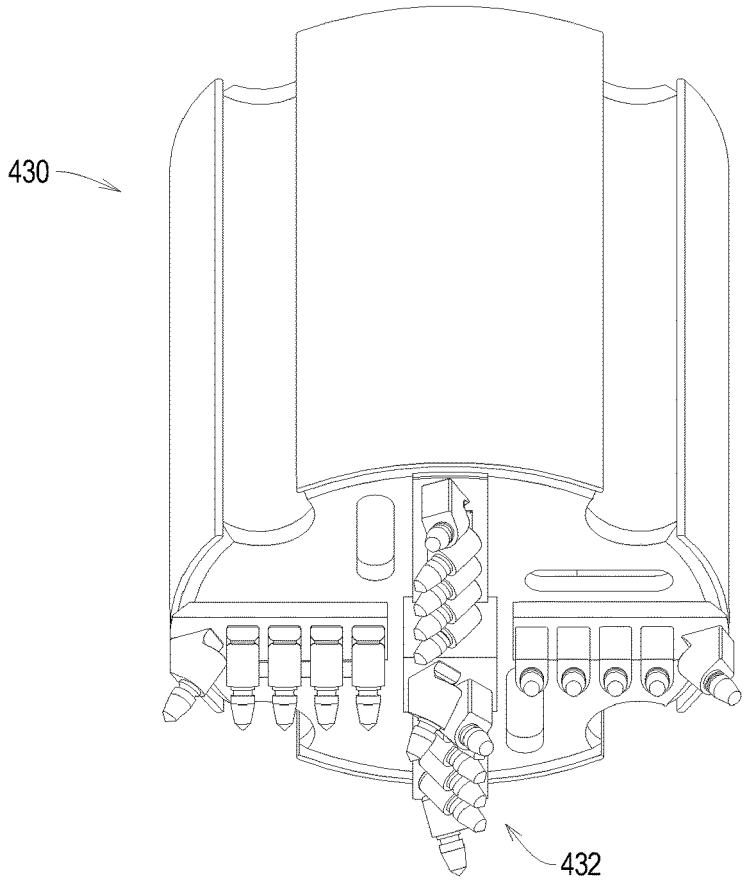
FIG. 16 is a perspective view of a third example bit portion that may be used to form a third example earth boring system of the present invention.
Figure 17:
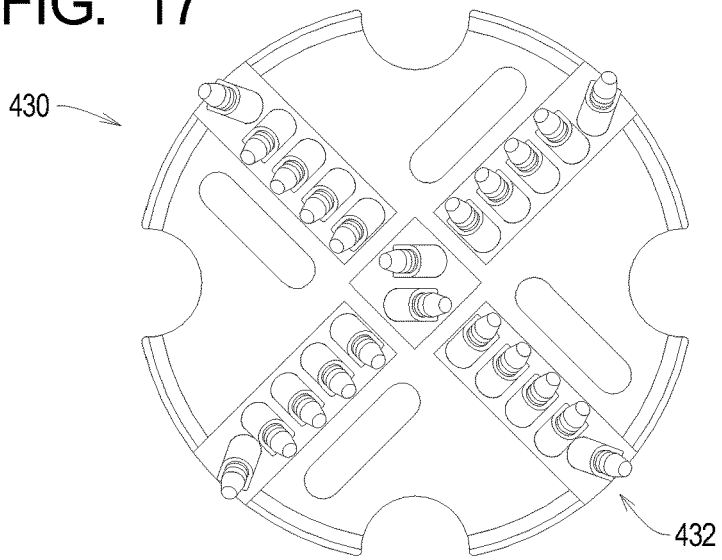
FIG. 17 is a bottom plan view of the third example bit portion.

FIGS. 16 and 17 depict a third example bit portion 430 with different dimensions and a different cutter assembly 432 than the example bit portions 22 and 420 and cutter assemblies 50 and 422 described above. The cutter assembly 432 comprises four groups of cutter heads radially extending from a center group of cutter heads and defines four cutter plate slots, with one cutter plate slot arranged between each pair of cutter head groups. The third example bit portion 430 may be used as part of a drill string like the example drill string 30 with appropriate sizing of the other parts of the drill string.

What is claimed is:

1. A drill string comprising:
- a bit portion;
- a distal extension portion;
- a proximal extension portion; and
- a connecting portion; whereby
- the bit portion is operatively connected to the distal extension portion and the connecting portion operatively connects the distal extension portion to the proximal extension portion to define
  - a supply path extending through the proximal extension portion, the connecting portion, the distal extension portion, and the bit portion to a cutter region associated with the bit portion; and
  - a return path extending from the cutter region through the bit portion, the distal extension portion, the connector portion, and the proximal extension portion;
- a portion of the return path defined by the distal extension portion surrounds the supply path; and
- the bit portion defines at least one housing groove, where the return path extends at least partly through the at least one housing groove.

2. A drill string as recited in claim 1, in which the connecting portion comprises:
- a first connector housing secured to the proximal extension portion;
- a second connector housing secured to the distal extension portion; and
- a connector member defining a connector passageway; wherein
- the first and second housings are secured to each other to transfer rotational forces from the proximal extension portion to the distal extension portion; and
- the connector member engages the proximal extension portion and the distal extension portion such that
  - a portion of the supply path extends through the connector passageway, and
  - a portion of the return path extends between the connector member and at least one of the first and second connector housings.

3. A drill string as recited in claim 2, in which the connecting portion further comprises at least one seal member arranged between the connector member and at least one of the first and second connector housings to inhibit the flow of material between the supply path and the return path.

4. A drill string as recited in claim 1, in which:
- the distal extension portion defines first and second distal extension housing members arranged to define distal supply and removal extension chambers;
- the proximal extension portion defines first and second proximal housing members arranged to define proximal supply and removal extension chambers; and
- the connecting portion comprises
  - a first connector housing secured to the proximal extension portion;
  - a second connector housing secured to the distal extension portion; and
  - a connector member defining a connector passageway; wherein
  - the first and second housings are secured to each other to transfer rotational forces from the proximal extension portion to the distal extension portion; and
  - the connector member engages the first distal extension housing member and the first proximal extension housing member such that
    - a portion of the supply path extends through the proximal supply extension chamber, the connector passageway, and the distal supply extension chamber, and
    - a portion of the return path extends through the distal removal extension chamber, between the connector member and at least one of the first and second connector housings, and through the proximal removal extension chamber.

5. A drill string as recited in claim 4, in which the connecting portion further comprises:
- at least one key projection; and
- at least one key slot; wherein
- the at least one key projection engages the at least one key slot to transfer rotational forces from the proximal extension portion to the distal extension portion.

6. A drill string as recited in claim 1, in which the connecting portion comprises:
- a first connector housing secured to the proximal extension portion;
- a second connector housing secured to the distal extension portion;
- at least one key projection; and
- at least one key slot; wherein
- the at least one key projection engages the at least one key slot to transfer rotational forces from the proximal extension portion to the distal extension portion.

7. A drill string as recited in claim 6, in which the connecting portion further comprises:

at least one first opening formed in the first connector housing;

at least one second opening formed in the second connector housing; and at least one connector screw adapted to engage the at least one first opening and the at least one second opening to secure the proximal extension portion to the distal extension portion.

8. A drill string as recited in claim 1, in which the connecting portion further comprises at least one seal member arranged to inhibit the flow of material between the supply path and the return path.

9. A drill string as recited in claim 1, in which the bit portion comprises:

a bit;

a bit coupler;

a bit housing for supporting the bit and the bit coupler; and at least one coupler pin; wherein the at least one coupler pin engages the bit housing and the distal extension portion to secure the bit portion to the distal extension portion to transfer rotation of the distal extension portion to the bit.

10. A drill string as recited in claim 9, further comprising at least one seal member arranged between the bit coupler and the distal extension portion to inhibit the flow of material between the supply path and the return path.

11. A drill string as recited in claim 1, in which:

the distal extension portion defines first and second distal extension housing members arranged to define distal supply and removal extension chambers, where the first distal extension housing member defines at least one first coupler pin opening;

the proximal extension portion defines first and second proximal housing members arranged to define proximal supply and removal extension chambers, where the second distal extension housing member defines at least one second coupler pin opening; and the bit portion comprises:

a bit;

a bit coupler defining at least one coupler pin groove;

a bit housing for supporting the bit and the bit coupler; and at least one coupler pin; wherein the at least one coupler pin extends through the at least one second coupler pin opening and the at least one first coupler pin opening and is arranged at least partly within the at least one coupler pin groove to secure the bit portion to the distal extension portion to transfer rotation of the distal extension portion to the bit.

12. A method of forming a hole in the earth comprising the steps of:

providing a bit portion defining at least one housing groove;

the bit portion is operatively connected to a distal extension portion;

operatively connecting the distal extension portion to a proximal extension portion to define a supply path extending through the proximal extension portion, the distal extension portion, and the bit portion to a cutter region associated with the bit portion;

a return path extending from the cutter region through the bit portion, the distal extension portion, the connector portion, and the proximal extension portion, where the return path extends at least partly through the at least one housing groove; and a portion of the return path defined by the distal extension portion surrounds the supply path;

engaging the bit portion with the earth;

rotating the proximal portion to cause rotation of the bit portion through the distal extension portion;

forcing drill fluid through the supply path and to the cutter region; and collecting drill fluid in the cutter region through the return path.

13. A method as recited in claim 12, in which the step of operatively connecting the distal extension portion to the proximal extension portion comprises the steps of:

securing a first connector housing to the proximal extension portion;

securing a second connector housing to the distal extension portion; and securing the first and second housings to each other to transfer rotational forces from the proximal extension portion to the distal extension portion; and arranging a connector member to engage the proximal extension portion and the distal extension portion such that a portion of the supply path extends through the connector passageway, a portion of the return path extends between the connector member and at least one of the first and second connector housings.

14. An earth boring system for forming a hole in the earth, comprising:

a drill string comprising a bit portion defining at least one housing groove;

a distal extension portion;

a proximal extension portion; and a connecting portion;

a drive system;

a drill fluid supply; and a drill debris collector; whereby the bit portion is operatively connected to the distal extension portion and the connecting portion operatively connects the distal extension portion to the proximal extension portion to define a supply path extending through the proximal extension portion, the connecting portion, the distal extension portion, and the bit portion to a cutter region associated with the bit portion;

a return path extending from the cutter region through the bit portion, the distal extension portion, the connector portion, and the proximal extension portion; and a portion of the return path defined by the distal extension portion surrounds the supply path;

the drill fluid supply forces drill fluid through the supply path such that the drill fluid mixes with cuttings in the cutter region to form drill debris, the drill debris flows back up through the return path; and the drill debris collector collects the drill debris; and the return path extends at least partly through the at least one housing groove.

15. An earth boring system as recited in claim 14, in which the connecting portion comprises:

a first connector housing secured to the proximal extension portion;

a second connector housing secured to the distal extension portion; and a connector member defining a connector passageway; wherein the first and second housings are secured to each other to transfer rotational forces from the proximal extension portion to the distal extension portion; and the connector member engages the proximal extension portion and the distal extension portion such that a portion of the supply path extends through the connector passageway, and a portion of the return path extends between the connector member and at least one of the first and second connector housings.

16. An earth boring system as recited in claim 14, in which:

the distal extension portion defines first and second distal extension housing members arranged to define distal supply and removal extension chambers;

the proximal extension portion defines first and second proximal housing members arranged to define proximal supply and removal extension chambers; and the connecting portion comprises a first connector housing secured to the proximal extension portion;

a second connector housing secured to the distal extension portion; and a connector member defining a connector passageway; wherein the first and second housings are secured to each other to transfer rotational forces from the proximal extension portion to the distal extension portion; and the connector member engages the first distal extension housing member and the first proximal extension housing member such that a portion of the supply path extends through proximal supply extension chamber, the connector passageway, and the distal supply extension chamber, and a portion of the return path extends through the distal removal extension chamber, between the connector member and at least one of the first and second connector housings, and through the proximal removal extension chamber.

17. A drill string comprising:

a bit portion;

a distal extension portion;

a proximal extension portion; and a connecting portion; whereby the bit portion is operatively connected to the distal extension portion and the connecting portion operatively connects the distal extension portion to the proximal extension portion to define a supply path extending through the proximal extension portion, the connecting portion, the distal extension portion, and the bit portion to a cutter region associated with the bit portion; and a return path extending from the cutter region through the bit portion, the distal extension portion, the connector portion, and the proximal extension portion; and the bit portion defines at least one housing groove, where the return path extends at least partly through the at least one housing groove.

18. A drill string comprising:

a bit portion comprising a bit, a bit coupler, a bit housing for supporting the bit and the bit coupler, where the bit housing defines at least one housing groove, and at least one coupler pin;

a distal extension portion;

a proximal extension portion; and a connecting portion; whereby the at least one coupler pin engages the bit housing and the distal extension portion to secure the bit portion to the distal extension portion to transfer rotation of the distal extension portion to the bit;

the bit portion is operatively connected to the distal extension portion and the connecting portion operatively connects the distal extension portion to the proximal extension portion to define a supply path extending through the proximal extension portion, the connecting portion, the distal extension portion, and the bit portion to a cutter region associated with the bit portion; and a return path extending from the cutter region through the bit portion, the distal extension portion, the connector portion, and the proximal extension portion; and the return path extends at least partly through the at least one housing groove.

19. A method of forming a hole in the earth comprising the steps of:

providing a bit portion defining at least one housing groove;

the bit portion is operatively connected to a distal extension portion;

operatively connecting the distal extension portion to a proximal extension portion to define a supply path extending through the proximal extension portion, the distal extension portion, and the bit portion to a cutter region associated with the bit portion, a return path extending from the cutter region through the bit portion, the distal extension portion, the connector portion, and the proximal extension portion, and the return path extends at least partly through the at least one housing groove; and engaging the bit portion with the earth;

rotating the proximal portion to cause rotation of the bit portion through the distal extension portion;

forcing drill fluid through the supply path and to the cutter region; and collecting drill fluid in the cutter region through the return path.

20. An earth boring system for forming a hole in the earth, comprising:

a drill string comprising a bit portion, where the bit portion defines at least one housing groove, a distal extension portion, a proximal extension portion, and a connecting portion;

a drive system;

a drill fluid supply; and a drill debris collector; whereby the bit portion is operatively connected to the distal extension portion and the connecting portion operatively connects the distal extension portion to the proximal extension portion to define a supply path extending through the proximal extension portion, the connecting portion, the distal extension portion, and the bit portion to a cutter region associated with the bit portion, a return path extending from the cutter region through the bit portion, the distal extension portion, the connector portion, and the proximal extension portion, and the return path extends at least partly through the at least one housing groove;

the drill fluid supply forces drill fluid through the supply path such that the drill fluid mixes with cuttings in the cutter region to form drill debris, and the drill debris flows back up through the return path; and the drill debris collector collects the drill debris.

21. A drill string comprising:

a bit portion comprising a bit;

a bit coupler;

a bit housing for supporting the bit and the bit coupler; and at least one coupler pin;

a distal extension portion;

a proximal extension portion; and a connecting portion; whereby the bit portion is operatively connected to the distal extension portion and the connecting portion operatively connects the distal extension portion to the proximal extension portion to define a supply path extending through the proximal extension portion, the connecting portion, the distal extension portion, and the bit portion to a cutter region associated with the bit portion; and a return path extending from the cutter region through the bit portion, the distal extension portion, the connector portion, and the proximal extension portion;

the at least one coupler pin engages the bit housing and the distal extension portion to secure the bit portion to the distal extension portion to transfer rotation of the distal extension portion to the bit;

a portion of the return path defined by the distal extension portion surrounds the supply path; and the bit housing defines at least one housing groove, where the return path extends at least partly through the at least one housing groove.

* * * * *